US006491806B1

(12) United States Patent
Dubin et al.

(10) Patent No.: US 6,491,806 B1
(45) Date of Patent: Dec. 10, 2002

(54) ELECTROPLATING BATH COMPOSITION

(75) Inventors: Valery Dubin, Portland, OR (US); Kimin Hong, Hillsboro, OR (US); Nate Baxter, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/560,671

(22) Filed: Apr. 27, 2000

(51) Int. Cl.[7] ..... C25D 3/38

(52) U.S. Cl. ..... 205/296; 205/123; 205/297; 205/298

(58) Field of Search ..... 205/296, 297, 205/298, 123

(56) References Cited

U.S. PATENT DOCUMENTS 3,859,337 A * 1/1975 Herz et al. ..... 260/500.5 H
4,272,335 A * 6/1981 Combs ..... 205/298
4,555,315 A 11/1985 Barbieri et al.
4,990,224 A 2/1991 Mahmoud
5,151,170 A 9/1992 Montgomery et al.
5,433,840 A 7/1995 Dahms et al.
5,514,261 A * 5/1996 Herklotz et al. ..... 205/238
6,224,737 B1 * 5/2001 Tsai et al. ..... 205/123

* cited by examiner

*Primary Examiner*—Nam Nguyen
*Assistant Examiner*—William T. Leader
(74) *Attorney, Agent, or Firm*—Blakely, Sokoloff, Taylor & Zafman LLP

(57) ABSTRACT

The present invention relates to a copper electroplating bath composition and method of using it for microelectronic device fabrication. In particular, the present invention relates to copper electroplating in the fabrication of interconnect structures in semiconductor devices. By use of the inventive copper electroplating bath composition, the incidence of voids in the interconnect structures is reduced.

16 Claims, 5 Drawing Sheets

ELECTROPLATING BATH COMPOSITION

BACKGROUND OF THE INVENTION

1. Field of the Invention

The present invention relates generally to electroplating. More particularly, the present invention relates to microelectronic device fabrication. In particular, the present invention relates to copper electroplating in the fabrication of interconnect structures in semiconductor devices.

2. Description of Related Art

Copper electroplating processes have been used in the semiconductor industry to fill structures such as dual damascene trenches and contact holes. Miniaturization is the process of reducing the size of semiconductor devices, while crowding more devices onto a relatively smaller area of a substrate.

One phenomenon that is observed during semiconductor fabrication electroplating is the formation of defects such as voids in the metallization. As miniaturization continues to progress, the relative size of a void increases. A significant number of voids will result in a detrimentally lowered conductivity of a metallization such as a contact as well as poor electromigration resistance. In some cases, the void or voids may be sufficiently large to cause an open circuit and the device fails. FIG. 1 is a prior art depiction of a semiconductor structure 10 comprising a substrate with a recess 14 therein. A seed layer 16 is located at the bottom and on the sidewalls of recess 14 and a contact 18 fills recess 14. Present are voids 20 in contact 18. The voids 20 are caused by such forces as non-uniform nucleation at seed layer 16 during plating and inadequate nucleation at a pinhole 22, and large grain formation during plating.

One method of plating comprises using a commercially available copper plating bath composition such as ULTRAFILL™ from Shipley Company, of Marlborough Mass. Other commercially available copper plating bath compositions are is VIAFORM™ and CuBATH® from Enthone-OMI Inc. of West Haven, Conn. However, use of these copper plating baths may result in a detrimental defect-or voids count besides the contact fill capability may be compromised and incomplete filling may be observed in the contacts.

What is needed is an electroplating bath composition and process that overcomes the problems of the prior art. What is also needed is an inventive contact that overcomes the problems of the prior art.

BRIEF DESCRIPTION OF THE DRAWINGS

In order that the manner in which the above recited and other advantages of the invention are obtained, a more particular description of the invention briefly described above will be rendered by reference to specific embodiments thereof which are illustrated in the appended drawings. Understanding that these drawings depict only typical embodiments of the invention that are not necessarily drawn to scale and are not therefore to be considered to be limiting of its scope, the invention will be described and explained with additional specificity and detail through the use of the accompanying drawings in which.

DETAILED DESCRIPTION OF THE INVENTION

Figure 1:
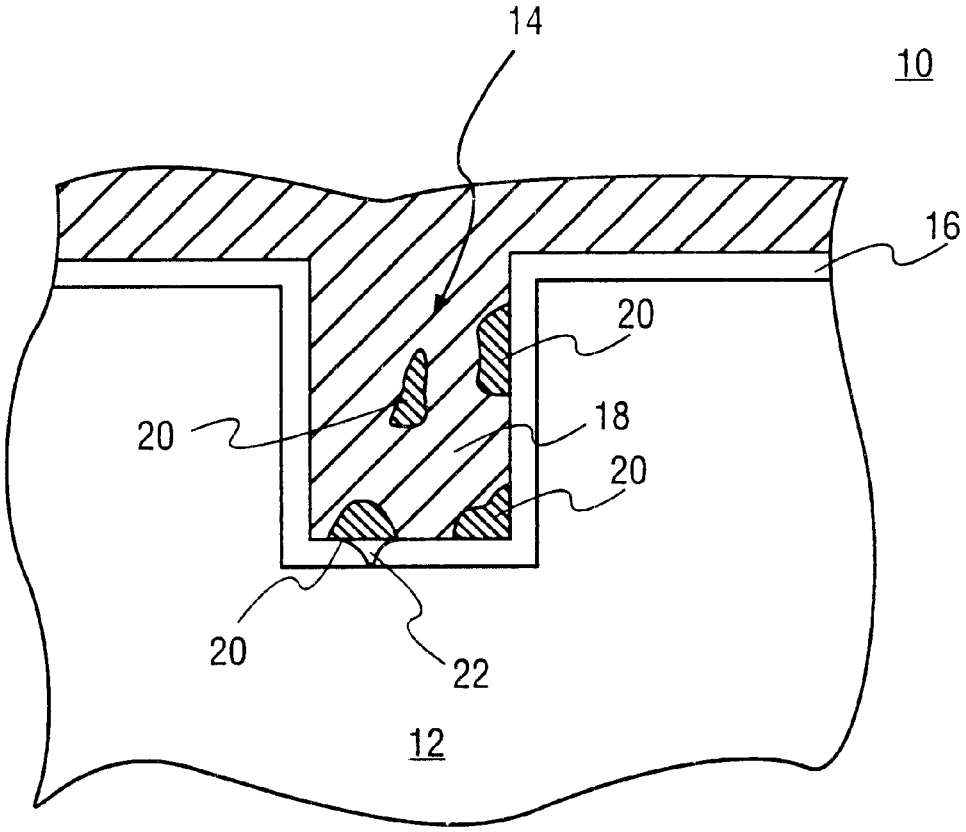
FIG. 1 (PRIOR ART)
FIG. 1 is an elevational cross-section view of a semiconductor structure that depicts detrimental voids according to the prior art.

The present invention relates to plating of a semiconductor structure by use of an inventive copper bath composition. Because of the inventive use of the copper bath composition, grain size is controlled and the presence of voids is reduced. Additionally, because of the inventive use of the copper bath composition, an article results in the form of an inventive contact structure.

The term "substrate" generally refers to the physical object that is the basic workpiece that is transformed by various process operations into the desired article. A substrate may also be referred to as a wafer. Wafers may be made of semiconducting, non-semiconducting, or combinations of semiconducting and non-semiconducting materials.

The inventive plating bath composition is preferably an aqueous electroplating composition. It comprises copper, at least one acid, selected from sulfuric, methane sulfonic, amidosulfuric, aminoacetic, fluoroboric, and mixtures thereof and the like, at least one halogen ion, and at least one additive selected from an accelerating agent, a suppressing agent, and an accelerating-suppressing agent.

A preferred range of copper ions in the inventive plating bath composition is from about 0.1 mole/L to about 1.5 mole/L, preferably from about 0.2 mole/L to about 1 mole/L, and more preferably about 0.23 mole/L.

In addition to copper, other metals may be combined with the copper such as refractory metals, noble metals, and other transition metals. Examples of useful refractory metals that may be combined with the copper include vanadium, niobium, tantalum, chromium, molybdenum, tungsten, cobalt, rhenium, and the like, and combinations thereof. Examples of useful noble metals that may be combined with the copper include gold, silver. Other useful metals that may be combined with the copper include nickel, palladium, platinum, zinc, ruthenium, rhodium, cadmium, indium, and the like, and combinations thereof. Other useful metals that may be combined with copper include alkaline earth metals such as magnesium and the like. As a whole, the inventive plating bath composition contains a preferred range of total metal deposit ions in a range from about 0.01 mole/L to about 1.5 mole/L, preferably from about 0.1 mole/L to about 1 mole/L, and most preferably about 0.23 mole/L. The preferred ratio of copper to any other(s) metal ions is in a range from about 1:1 to about 100:1, preferably from about 2:1 to about 50:1.

Additionally, the bath composition may contain mineral acids such as sulfuric, fluoboric, combinations thereof, and the like. The bath composition may also contain organic acids such as methane sulfonic (MSA), amidosulfuric, aminoacetic, combinations thereof, and the like. The bath composition may also contain combinations of mineral acids and organic acids. A preferred concentration range of acids in the inventive plating bath composition is from about 0.1 mole/L to about 4 mole/L, preferably from about 0.15 mole/L to about 3.6 mole/L, and more preferably from about 0.2 mole/L to about 2.6 mole/L. Alternatively, the effective acid content in the inventive plating bath composition may be expressed by pH in a preferred range from about pH <0 to about pH 14, preferably from about pH 0.4 to about pH 3.

The plating bath composition may include at least one halogen such as fluorine, chlorine, bromine, iodine, and combinations thereof. Preferably, the plating bath composition includes at least one halogen of chlorine or bromine. A preferred range of halogens in the inventive plating bath composition is the range from about 150 μmole/L to about 3500 μmole/L, preferably from about 1000 μmole/L to about 3225 μmole/L.

The inventive copper plating bath composition also includes additives. The additives may allow for an industrial plating rate of copper and its optional alloying metals upon the substrate depending upon the concentration. The additives include accelerating agents, suppressing agents, and suppressing-accelerating agents. The suppressing-accelerating agent has a plating accelerating effect at low concentrations and a plating suppressing effect at high concentrations as set forth herein.

The at least one additive may include binary combinations such as an accelerating agent and a suppressing agent, or an accelerating agent and an accelerating-suppressing agent, or a suppressing agent and an accelerating-suppressing agent. Additionally, the at least one additive may include all three agents.

Accelerating agents may include a bath composition soluble disulfide or monosulfide organic compound including their mixtures. One accelerating agent is SPS, 1-propane sulfonic acid, 3,3'-dithio-bis, di-sodium salt, that may include bis-(sodium-sulfopropyl)- disulfide as the di-sodium salt. Another accelerating agent is 1-propanesulfonic acid, 3-[(ethoxy-thiomethyl)thio],-potassium salt. Another accelerating agent is a phosphonated disulfide. Another accelerating agent is a sulphonated or a phosphonated monosulfide, such as 3-mercapto-1-propanesulfonic acid (MPS) or 2-Mercaptoethanesulfonic acid (MES).

In one embodiment, the aqueous electroplating bath composition uses an accelerating agent that is selected from a disulfide organic compound, a monosulfide organic compound, mixtures thereof, and the like. Preferably, the accelerating agent is provided in a concentration range from about 2 μmole/liter to about 500 μole/liter. In one embodiment, the accelerating agent comprises SPS in a concentration range from about 2 μmole/liter to about 500 μmole/liter, preferably from about 5 μmole/liter to about 250 μmole/liter.

In another embodiment, the accelerating agent comprises a phosphonated disulfide in a concentration range from about 2 μmole/liter to about 500 μmole/liter, preferably from about 5 μmole/liter to about 250 μmole/liter.

In another embodiment, the accelerating agent is selected from a sulphonated monsulphide and a phosphonated monosulfide in a concentration range from about 2 μmole/liter to about 500 μmole/liter, preferably from about 5 μmole/aiter to about 250 μmole/liter.

In another embodiment, the accelerating agent is selected from 3-mercapto-1-propanesulfonic acid, and 2-mercaptoethanesulfonic acid sodium salt in a concentration range from about 2 μmole/liter to about 500 μmole/liter, preferably from about 5 μmole/liter to about 250 μmole/liter.

The accelerating agent may also be selected from acylthioureas, thiocarboxylic acid amides, thiocarbamates, thiosemicarbazones, thiohydantoin, mixtures thereof, and the like in a concentration range from about 2 μmole/liter to about 500 μmole/liter, preferably from about 5 μmole/liter to about 250 μmole/liter. The accelerating agent may comprise (O-Ethyldithiocarbonato)-S-(3-sulfopropyl)-ester, potassium salt.

The suppressing agent is provided in a concentration range from about 0.6 μmole/liter to about 600 μmole/liter, preferably, from about 3 μmole/liter to about 300 μmole/liter.

In one embodiment, the suppressing agent comprises a cross-linked polyamide in a concentration range from about 0.6 μmole/liter to about 600 μmole/liter, and wherein the cross-linked polyamide has an average molecular weight in a range from about 2,000 gram/mole to about 3,000 gram/mole.

In another embodiment, the suppressing agent is selected from a polyether such as polyoxyethylene lauryl ether (POE). The suppressing agent may also be a glycol such as polyethylene glycol, polypropylene glycol, combinations thereof, and the like.

The suppressing agent may also be, an aromatic compound such as alkoxylated beta-naphtol, alkyl naphthalene sulphonate, combinations, and the like. In one embodiment, the suppressing agent is selected from a polyether, a polyethylene, a naphtol, a sulphonate, a polyamine, a polyimid, and mixtures thereof. In another embodiment, the suppressing agent comprises a beta-naphtol having the structure:

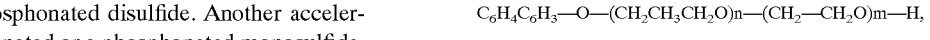

$$C_6H_4C_6H_3—O—(CH_2CH_3CH_2O)n—(CH_2—CH_2O)m—H,$$

wherein n may be equal to 1 and wherein m may be equal to 1, and wherein the molecular weight is in the range from about 800 to about 1,500. The suppressing agent may also be polyethylene oxide.

The suppressing agent may also be a nitrogen-containing compound such as polyimines, poly amines, polyamids, combinations and the like. Additionally, the suppressing agent may be cross-combinations of any two up to all of ethers, glycols, double aromatics, polyethylenes, and nitrogen-containing compounds.

Suppressing-accelerating agents can be acid salts such as a bath soluble DPS, N,N-Dimethyl-dithiocarbamyl propyl sulfonic acid, sodium salt that may have the configuration (CH3)2N—S—C—S(CH2)2SO3Na. The suppressing-accelerating agent is provided in a concentration range from about 1 μmole/liter to about 500 μmole/liter, preferably from about 8 μmole/liter to about 350 μmole/liter. In one embodiment, the accelerating-suppressing agent comprises DPS, N,N-dimethyl-dithiocarbamyl propyl sulfonic acid, sodium salt. DPS acts as an accelerator a lower concentrations and as a suppressor at higher concentrations.

Examples of the inventive electroplating bath composition are set forth in Table 1.

TABLE 1

ELECTROPLATING BATH COMPOSITIONS

| Sample No. | Cu, mole/L | Me, mole/L | Acid, mole/L | Halogen, μmole/L | Accelerating Agent' μmole/L | Suppressing Agent' μmole/L | S-A Agent' μmole/L |
|---|---|---|---|---|---|---|---|
| 1 | 0.28 | — | H2SO4 1.84 | Cl 1612 | SPS 25 | PEG 3400 (MW) 400 | — |
| 2 | 0.28 | — | H2SO4 1.84 | Cl 2250 | SPS 8 | PPG 2000 (MW) 130 | DPS 200 |
| 3 | 1 | — | H2SO4 0.2 | Cl 2500 | MPS 12 | PPG 1000 (MW) 500 | — |
| 4 | 0.3 | Zn 0.1 | H2SO4 2 | Br 375 | MES 100 | POE 40 | — |
| 5 | 0.4 | Mg 0.2 | MSA 1 | Cl 1000 | SPS 35 | PEG 4000 (MW) 200 | DPS 100 |
| 6 | 0.8 | — | MSA 1.2 | I 500 | MPS 100 | Beta-naphtol 1000 (MW) 100 | — |
| 7 | 0.23 | — | H2SO4 2.5 | Cl 2000 | SPS 50 | PEG 8000 (MW) 50 | — |
| 8 | 0.5 | Sn 0.015 | H2SO4 2.2 | Cl 2600 | MPS 75 | POE 100 | — |

Operating conditions according to present invention may be selected depending upon a particular application. The wafer may be contacted by the copper plating bath composition by moving the bath composition in relation to the wafer. For example, the wafer may be rotated. A preferred rotation speed is in the range from about 0 to about 500 rpm. Optionally, the bath composition may be rotated and the wafer held in place. This embodiment allows for the elimination of moving parts in a wafer electroplating chamber with the advantage of reducing the liklihood of particulates contaminating the electroplating bath composition.

In one embodiment, a plating tool containing 1–25 plating chambers is loaded with between and one and 25 wafers and the inventive copper plating bath composition is flowed at a rate from about 3 L/min to about 60 L/min for each wafer. Where the wafer is rotated, or the solution is rotated, the wafer rotation speed, relative to the solution, is between 0 rpm and about 500 rpm.

Depending upon the specific chemical make-up of the plating bath composition and the preferred plating amount, the temperature is between about 7 C and about 35 C.

Reference will now be made to the drawings wherein like structures will be provided with like reference designations. In order to show the structures of the present invention most clearly, the drawings included herein are diagrammatic representations of inventive articles. Thus, the actual appearance of the fabricated structures, for example in a photomicrograph, may appear different while still incorporating the essential structures of the present invention. Moreover, the drawings show only the structures necessary to understand the present invention. Additional structures known in the art have not been included to maintain the clarity of the drawings.

Figure 2:
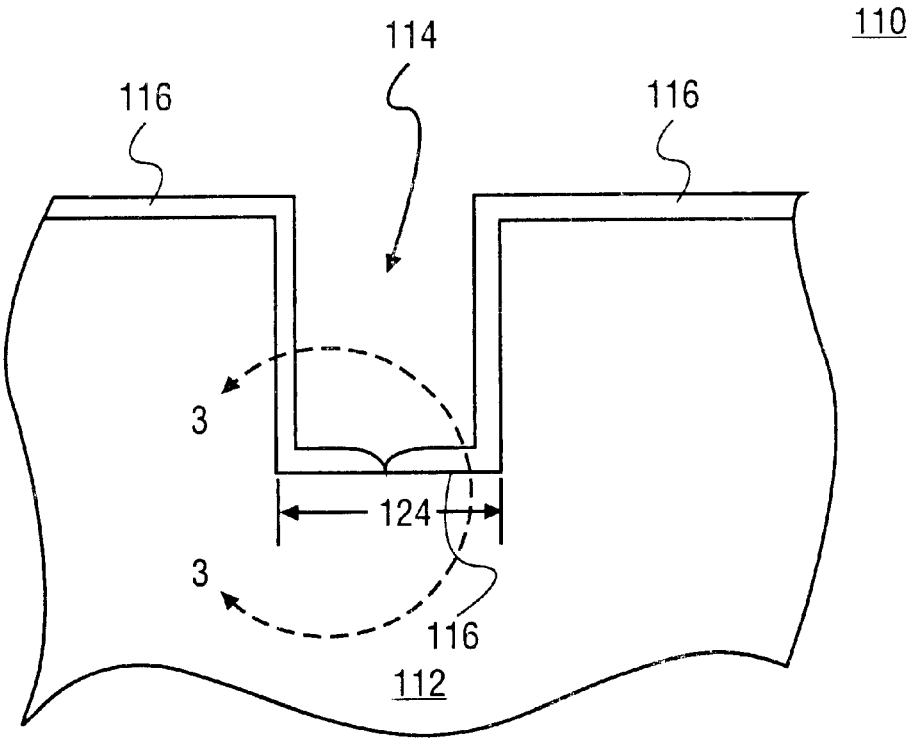
FIG. 2 is an elevational cross-section view of a semiconductor structure that illustrates formation according to the present invention.

The following is an example of a method of carrying out the present invention. In FIG. 2, a semiconductor structure 110 is provided with a recess 114 in a substrate 112. Recess 114 may have an aspect ratio in a range from about 1:1 to about 10:1 or higher. Preferably, recess 114 has an aspect ratio in a range from about 4:1 to about 6:1. Recess 114 has a characteristic width 124 in a range from about 0.02 microns to about 100 microns, preferably from about 0.05 microns to about 0.2 microns, and most preferably about 0.1 micron.

A seed layer 116 is formed over substrate 112 and within recess 114. Seed layer 116 may be formed, either by chemical vapor deposition (CVD) or by physical vapor deposition (PVD). Where CVD is employed, the grain structure of seed layer 116 may have a crystal orientation of <200>. Where PVD is employed, the grain structure of seed layer 116 may have a crystal orientation of <111>. Seed layer 116 is depicted in FIG. 2 as being formed by PVD. Seed layer 116 may be comprised of substantially pure copper, or it may be comprised of an alloy or solid solution of metals that is either chemically or physically formed upon substrate 112.

Prior to placing semiconductor structure 110 into an inventive plating bath composition, substrate 112 may be pre-cleaned by a pre-rinse such as with about 0–50 mL deionized (DI) water. Other pre-rinsing may be done such as by distilled water. Additionally, the pretreatment may optionally be a reducing process wherein a cathodic state is impressed upon substrate 112 such that oxidation at the seed layer 116 is reversed. Other pretreatment may include organic and inorganic solvents, mineral and organic acids, strong and weak bases, and combinations of any of the above.

The operating range of the plating bath composition is between about 7 C and about 35 C. The solution and wafer are contacted with a relative rotation rate as set forth herein. A multi-step changing, DC waveform process is instituted that includes initiation at a current density in a range from 0.3 mA/cm$^2$ to about 7 mA/cm$^2$, filling at current a density in a range from about 7 mA/cm$^2$ to about 20 mA/cm$^2$, and bulk fill at current density in a range from about 20 mA/cm$^2$ to about 80 'nA/cm$^2$.

Figure 3:
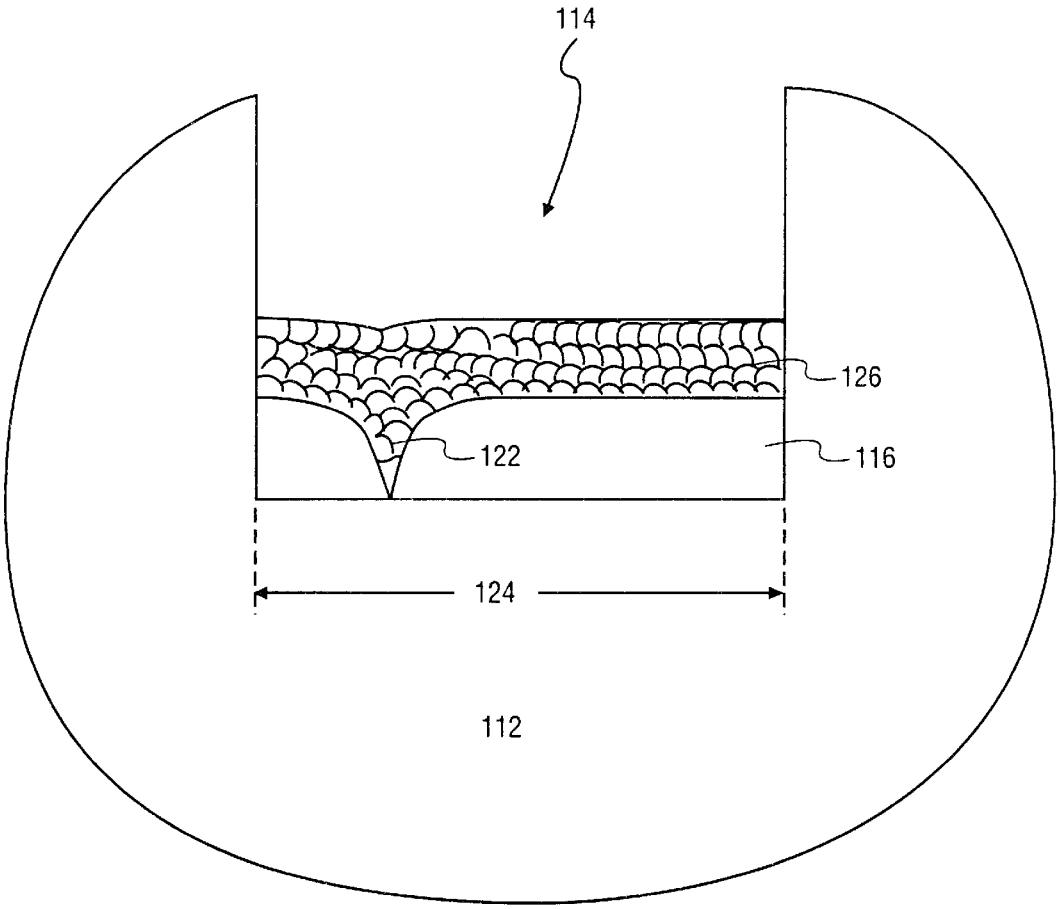
FIG. 3 illustrates a detail section view of the semiconductor structure that illustrates uniform nucleation and pinhole repair.

FIG. 3 illustrates further processing according to the present invention. FIG. 3 is a detail section taken from FIG. 2 along the section line 3—3. FIG. 3 illustrates the location of a pin hole 122 that resulted during seed layer formation and that is repaired by use of the inventive plating bath composition. Additionally, during nucleation and the propagation of contact formation, the size of grains 126 is in a range from about 0.5 nm, to about 20 nm. The inventive plating bath composition resists the formation of voids compared to the prior art. During subsequent thermal processing, the size of grains 126 enlarges but remains in a range from about 5 nm to about 100 nm. Plated copper in the recess 114 also contains sulfur in the range from 1 ppm to 200 ppm preferably from 10 ppm to 100 ppm.

Figure 4:
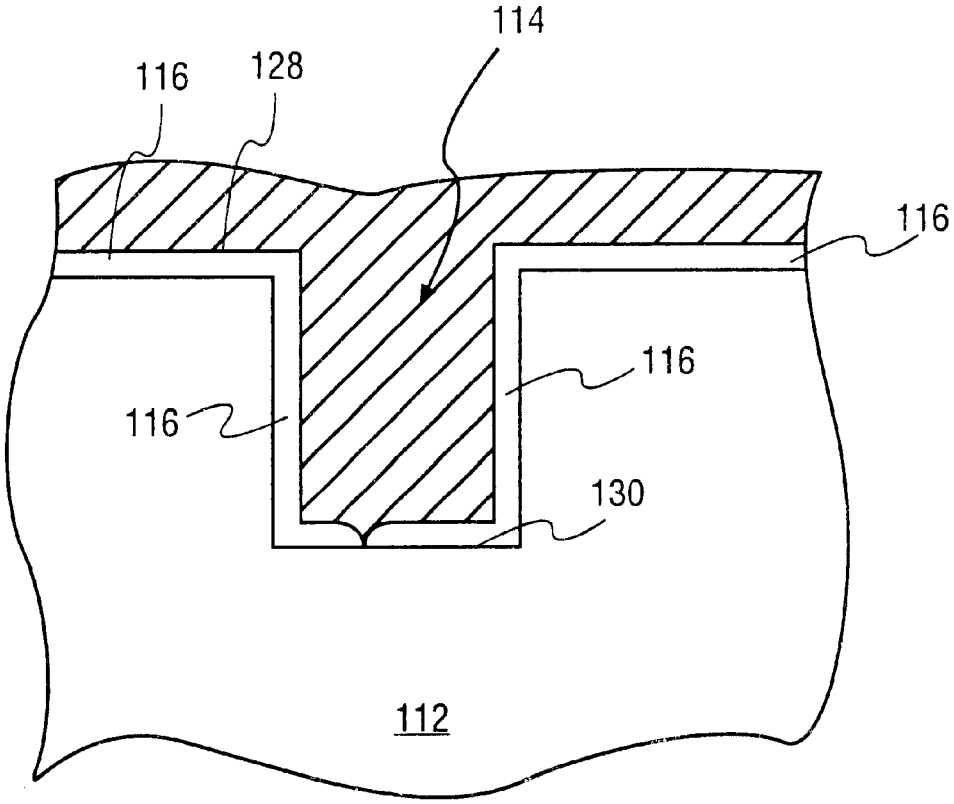
FIG. 4 illustrates the semiconductor structure in FIG. 2 after further processing.

FIG. 4 illustrates further processing of semiconductor structure 110 by use of the inventive plating bath composition. The inventive combination of process chemicals with at least one of the accelerator, the suppressor and the accelerator-suppressor acts to reduce defects by having uniform nucleation, repair of pin hole 122, and the elimination of grain mismatch that occurs in the prior art between seed layer 16 and contact 18 as illustrated in FIG. 1.

The inventive process achieves a balance of accelerating and suppressing activities to improve filling of recess 114. By use of a preferred accelerating-suppressing agent deposition is suppressed on the upper surface 128 of substrate 112 upon seed layer 116 where the concentration of the suppressing additives is high. Simultaneously, deposition of the copper is accelerated at the bottom 130 of recess 114 where concentration of the suppressing additives is low.

Another embodiment of the present invention is reverse pulse process with the following conditions. During induction of the process, there is a delay upon entry into the plating bath composition in a range from 0 to about 500 seconds. This delay may be referred to as a cold entry process. A cold entry process is in contrast to a hot entry process where there exists a potential in the plating bath composition before contact of the wafer therewith. The inventive plating bath composition is flowed in contact with the wafer at a flow rate in a range from about 3 L/min to about 60 L/min. The wafer is contacted by the inventive plating bath composition by a wafer rotation speed in a range from 0 to about 500 rpm. The bath temperature is maintained in a range from about 7 C to about 35 C.

Figure 5:
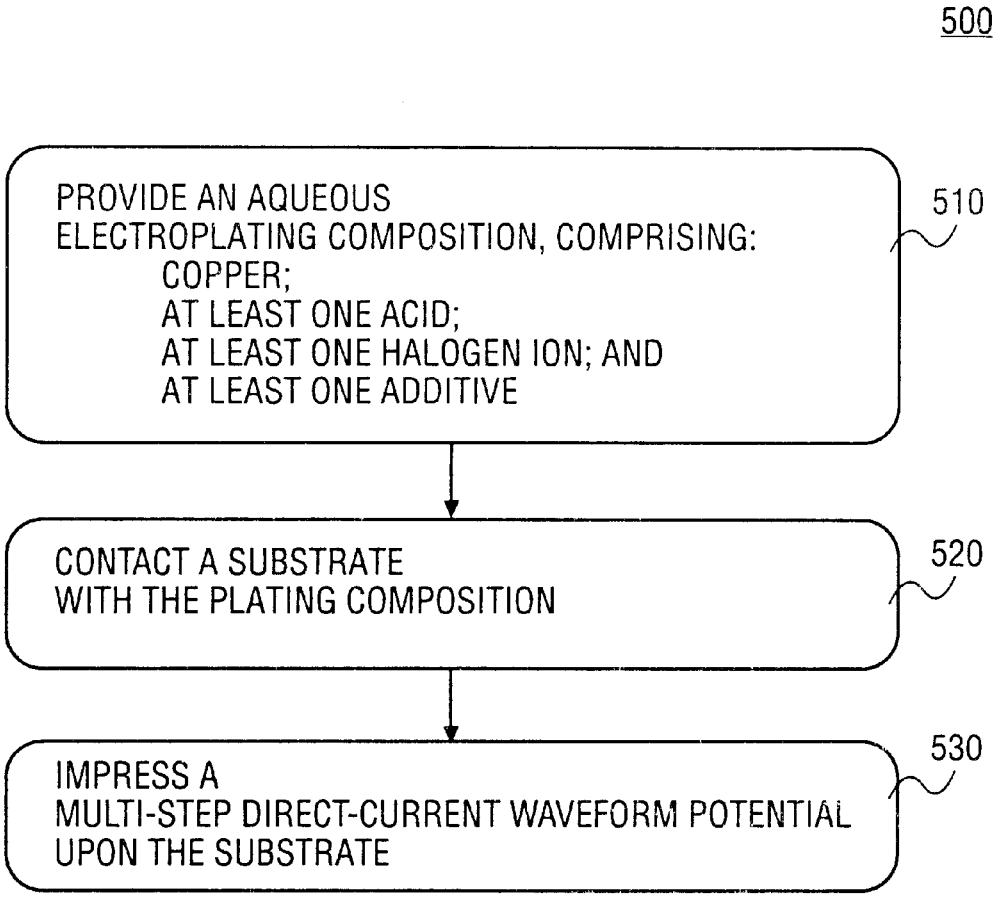
FIG. 5 illustrates the inventive process.

The waveform is a multi-step changing reverse pulse process including a nucleation current density from 3mA/cm$^2$ to 70 mA/cm$^2$, an initiation current density from 0.3 mA/cm$^2$ to 7 mA/cm$^2$, a fill step current density from 7 mA/cm to 20 mA/cm$^2$, a reverse pulse current density from 7 mA/cm$^2$ to 80 mA/cm$^2$, a forward pulse current density from 7 mA/cm$^2$ to 20 mA/cm$^2$, a reverse pulse current density from 7 mA/cm to 80 mA/cm$^2$, and a bulk fill current density from 20 mA/cm$^2$ to 80 mA/cm$^2$. During the stepped, changing current density that is imposed upon the plating bath composition, reverse pulsing time is in a range from about 1 ns to about 1 min, preferably from about 1 ms cycles to about 30 sec. FIG. 5 is an illustration of the inventive process 500. In process flow block 510, an aqueous electroplating composition is provided. The composition includes elements as set forth herein. In process flow block 520, substrate 112 is contacted with the inventive plating composition. In process flow block 530 a multi-step, direct-current waveform potential is impressed substrate 112.

Distinct advantages are realized with the present invention. Yield is increased when the inventive plating bath composition is used compared to those of the prior art. Because of the ever smaller geometries, yield becomes significant. The amount of defects in the form of voids is reduced, but more significantly, filling of the recess is more complete. Additionally, filling of a recess with an aspect ratio up to 10:1 is improved over the prior art.

It will be readily understood to those skilled in the art that various other changes in the details, material, and arrangements of the parts and method stages which have been described and illustrated in order to explain the nature of this invention may be made without departing from the principles and scope of the invention as expressed in the subjoined claims.

What is claimed is:

1. An electroplating composition comprising:

copper;

at least one acid, selected from sulfuric, methane sulfonic, amidosulfuric, aminoacetic, fluoboric, and mixtures thereof;

at least one halogen; and an accelerating-suppressing agent comprising DPS, N,N-Dimethyl-dithicarbamyl propyl sulfonic acid, sodium salt.

2. The aqueous electroplating composition according to claim 1, further comprising a suppressing agent.

3. The aqueous electroplating composition according to claim 1, further comprising an accelerating agent.

4. The aqueous electroplating composition according to claim 3, wherein the accelerating agent is selected from a disulfide organic compound, a monosulfide organic compound, and mixtures thereof.

5. The aqueous electroplating composition according to claim 3, wherein the accelerating agent is provi ded in a concentration range fro m about 2 micromole/liter to about 500 micromole/liter.

6. The aqueous electroplating composition according to claim 3, wherein the accelerating agent comprises 1-propane sulfonic acid, and 3,3'-dithio-bis di-sodium salt.

7. The aqueous electroplating composition according to claim 3, wherein the accelerating agent comprises 1-propane sulfonic acid, 3-[(ethoxy-thiomethyl)thio], -potassium salt.

8. The aqueous electroplating composition according to claim 3, wherein the accelerating agent comprises (O-Ethyldithiocarbonato)-S-(3-sulfopropyl)-ester, potassium salt.

9. The aqueous electroplating composition according to claim 3, wherein the accelerating agent comprises a phosphonated disulfide.

10. The aqueous electroplating composition according to claim 3, wherein the accelerating agent is selected from a sulphonated monosulfide and a phosphonated monosulfide.

11. The aqueous electroplating composition according to claim 3, wherein the accelerating agent is selected from 3-mercapto-1-propanesulfonic acid and 2-mercaptoethanesulfonic acid sodium salt.

12. The aqueous electroplating composition according to claim 2, wherein the suppressing agent is provided in a concentration range from about 0.6 micromole/liter to about 600 micromole/liter.

13. The aqueous electroplating composition according to claim 2, wherein the suppressing agent is selected from at least one of a polyether, polyethylene glycol, polypropylene glycol, polyoxyethylene lauryl ether, polyethylene oxide, alkoxylated beta-naphtol, alkyl naphthalene sulphonate, polyimines, poly amines, and polyamids.

14. The aqueous electroplating composition according to claim 2, wherein the suppressing agent comprises a beta-naphtol having the structure:

$$C_6H_4C_6H_3—O—(CH_2CH_3CH_2O)n-(CH_2—CH_2O)m-H,$$

wherein n may be equal to 1 and wherein m may be equal to 1, and wherein the molecular weight is in the range from about 800 to about 1,500.

15. The aqueous electroplating composition according to claim 2, wherein the suppressing agent comprises a cross-linked polyamide in a concentration range from about 0.6 $\mu$mole/liter to about 600 $\mu$mole/liter, and wherein the cross-linked polyamide has an average molecular weight in a range from about 2,000 to about 3,000 gram/mole.

16. The aqueous electroplating composition according to claim 1, wherein the accelerating-suppressing agent is provided in a concentration range from about 1 $\mu$mole/liter to about 500 $\mu$mole/liter.

* * * * *

UNITED STATES PATENT AND TRADEMARK OFFICE

CERTIFICATE OF CORRECTION

PATENT NO. : 6,491,806 B1 
DATED : December 10, 2002
INVENTOR(S) : Dubin et al.

It is certified that error appears in the above-identified patent and that said Letters Patent is hereby corrected as shown below:

Column 8,
Line 50, delete "provi ded" and insert -- provided --.
Line 51, delete "fro m" and insert -- from --.

Signed and Sealed this

Thirtieth Day of September, 2003

JAMES E. ROGAN
*Director of the United States Patent and Trademark Office*